US006178781B1

(12) United States Patent
Myers

(10) Patent No.: US 6,178,781 B1
(45) Date of Patent: Jan. 30, 2001

(54) PROCESS OF ROTARY KNITTING A TUBULAR BLANK WITH KNITTED POCKET ON MULTI-FEED CIRCULAR KNITTING MACHINE

(75) Inventor: Jonathan M. Myers, Winston-Salem, NC (US)

(73) Assignee: Sara Lee Corporation, Winston-Salem, NC (US)

( * ) Notice: Under 35 U.S.C. 154(b), the term of this patent shall be extended for 0 days.

(21) Appl. No.: 09/388,865

(22) Filed: Sep. 2, 1999

(51) Int. Cl.[7] ..... D04B 9/00; D04B 1/26; D04B 9/56

(52) U.S. Cl. ..... 66/8; 66/186; 66/187; 66/178 R; 66/42 R

(58) Field of Search ..... 66/182, 186, 187, 66/173, 8, 178 R, 42 R

(56) References Cited

U.S. PATENT DOCUMENTS 3,159,988 * 12/1964 Reymes-cole ..... 66/49
3,310,962 * 3/1967 Mahler et al. ..... 66/42
3,603,116 * 9/1971 Turini ..... 66/187
3,802,229 * 4/1974 Fregeolle ..... 66/176
3,975,929 * 8/1976 Fregolle ..... 66/172 E
4,492,099 * 1/1985 Safrit et al. ..... 66/202

* cited by examiner

*Primary Examiner*—Andy Falik
(74) *Attorney, Agent, or Firm*—Charles Y. Lackey

(57) ABSTRACT

A process of rotary knitting a tubular blank with a knitted pocket or pockets such as a heel or toe portion on a multi-feed circular knitting machine and products made by the process. The blank is preferably first knit with continuous courses of stitches on all needles, then with rotary knitting continuing on partial courses to form a pocket on one side of the blank while no other knitting on the blank is taking place. Each partial course has at its start a selected number of yarn end securing stitches such as tuck stitches, then a selected number of stitches to substantially form the partial course, and then a selected number of securing stitches at the end of the partial course, the purpose of the securing stitches being to lock in the yarn at the beginning and end of the partial course. This knitting pattern continues with the number of tuck stitches and other stitches in each partial course being varied to form a pocket of a predetermined design, one embodiment having the appearance and effect of a conventional gore and gore line like that formed by conventional reciprocatory knitting. When the pocket is completed, knitting can resume on all needles to form continuous complete courses of stitches.

8 Claims, 5 Drawing Sheets

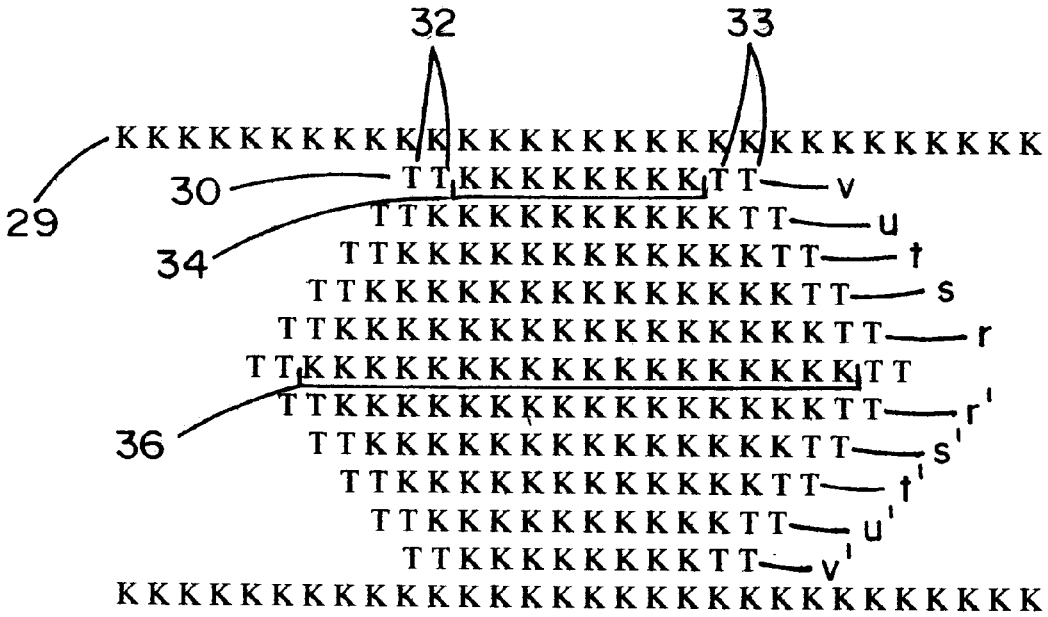
32
33
29
30
34
36
KKKK

PROCESS OF ROTARY KNITTING A TUBULAR BLANK WITH KNITTED POCKET ON MULTI-FEED CIRCULAR KNITTING MACHINE

BACKGROUND OF THE INVENTION

1. Field of the Invention

The present invention relates to rotary knitting on multi-feed circular knitting machines and more particularly to a process for knitting a tubular blank with a knitted pocket solely by rotary knitting on a multi-feed circular knitting machine where the pocket is formed by knitting partial courses on one side of the blank without any knitting on the other side of the blank.

2. Description of the Prior Art

Hosiery products, socks, panty hose, ladies fashion hosiery, tights and other tubular garments rotary knitted on circular knitting machines to fit the leg of the wearer traditionally have been made with heel, toe and other portions that are formed as pockets for extra fabric sections of the garment to accommodate that particular area of the lower extremity. With the advent of stretch yarns, it was not necessary in all cases to form pockets, since the stretchability of the knitted fabric would accommodate the heel or toes without undue wrinkles or other fabric deformities. However, when a precise fit is desired, the heel and toe portions on the hosiery blank are usually made by utilizing the technique of reciprocating the needle cylinder of the circular knitting machine as it knits so that it moves first in one direction and then reverses and moves in the opposite direction for the same distance. This reciprocating motion while knitting produces additional fabric on one side of the blank only that becomes an extra fabric heel or toe portion which terminates when reciprocation of the cylinder is terminated and rotary knitting is resumed to complete the blank.

Rotary knitting, particularly with panty hose and ladies fine denier fashion hosiery, can take place at much higher speeds than are possible in reciprocatory knitting. Such speeds are obtainable because the cylinder is constantly rotated in one direction smoothly and without having to accelerate and decelerate in order to change direction. Thus reciprocatory knitting of a heel and toe pocket requires a considerable amount of time when compared with the time required to knit the balance of the blank by rotary knitting and when compared to the time required to form rotary knit pockets in accordance with the present invention.

Various techniques have been utilized to attempt to rotary knit hosiery blanks with formed pockets for heels and toes. In substantially all cases, the attempt to provide additional fabric to the tubular member at a precise location to form a pocket portion solely by rotary knitting has failed because the additional fabric produced has been insufficient in quantity to effectively provide a suitably sized pocket because of the knitting technique used. Thus, there is a need for a more expeditious and reliable method of providing pockets (additional fabric) at specific locations on knitted tubes that form hosiery blanks or other products in order to reduce the time and cost of producing such blanks and to ultimately provide a garment with the needed quality, durability and fit. It is to this need that the present invention is directed.

OBJECTIVES AND SUMMARY OF THE INVENTION

A primary objective of the present invention is to provide a process for totally rotary knitting a tubular blank with a knitted pocket to form a heel or toe portion in the final hosiery garment on a multi-feed circular knitting machine which can have the appearance and effect of a conventionally reciprocated knitted heel or toe portion.

Another objective of the present invention is to provide a process of the type described that is capable of providing a pocket on a tubular blank by rotary knitting additional fabric on one side of the blank while not knitting on the other side of the blank.

Yet another objective of the present invention is to provide a process of the type described which will enable increased production of tubular blanks for making hosiery products having conventionally defined and effective heel and toe portions than previously possible.

Yet still another objective of the present invention is to provide a process for knitting a tubular blank with heel and toe pockets totally by rotary knitting that results in hosiery products having conventional gore line locations that are traditionally associated with women's fashion hosiery of the highest quality.

Still another objective of the present invention is to provide a process for knitting a tubular blank with heel and toe pockets totally by rotary knitting on a non-reciprocating knitting machine.

Thus, there has been outlined, rather broadly, and in summary form, the more important features of the invention in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods, and systems for carrying out the several purposes of this development. It is also to be understood that the abstract is neither intended to define the invention of the application, which is measured by the claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages, and the specific objects obtained by its use, reference should be made to the accompanying drawings and descriptive matter in which like characters of reference designate like parts throughout the several views.

BRIEF DESCRIPTION OF THE DRAWINGS

FIG. 8 is a schematic view of the stitch configuration forming the diamond design shown in FIG. 6;

FIG. 10 is a rear elevational and fragmentary view of the blank of FIG. 7 showing the pocket with gore lines shown as x's and partial courses shown as dotted lines;

FIG. 11 is a front elevational view of the blank shown in FIG. 7;

DETAILED DESCRIPTION OF PREFERRED EMBODIMENT

The present invention is a process for knitting a tubular blank solely by rotary knitting on a multi-feed circular knitting machine to produce hosiery products such as socks, panty hose, fine denier fashion hosiery, tights, and other tubular products with added fabric forming pockets such as hosiery heel and/or toe portions. The process enables the formation of a knitted pocket in a tubular hosiery blank on one side of the blank without knitting on the other side of the blank solely by rotary knitting thus making a more defined pocket than those made by previous processes. A variety of designs such as, but not limited to, a straight gore heel, a Y gore heel or a diamond gore heel may be used to practice the process. Forming pockets on a blank solely through rotary knitting is a significant advance in the art since conventional practices require reciprocatory knitting whereby the needle cylinder of the circular knitting machine must be reciprocated to add additional courses of yarn on one side of the blank without knitting on the other side of the blank to form such pockets.

Figure 3:
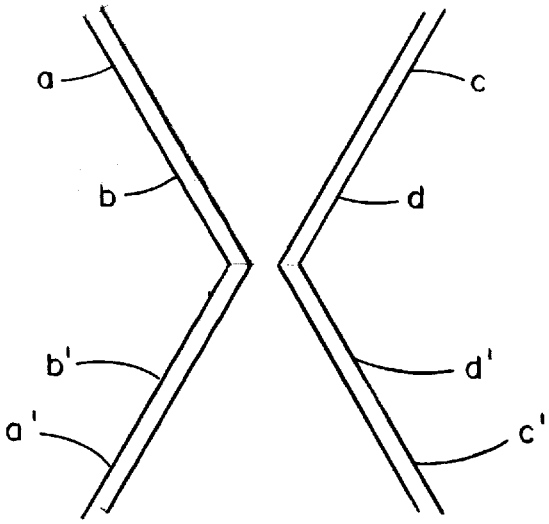
FIG. 3 is a schematic view of the stitch configuration opened at the gore line forming the gore design shown in FIGS. 1 and 2 with the provision of a, a' and b, b' locations along the first edge and c, c' and d, d' locations on the opposite edge thus illustrating shared locations on the actual joined gore line, i.e.; a, a' are at the same location; b, b' are at the same location; c, c' are at the same location; and d, d' are at the same location.
Figure 1:
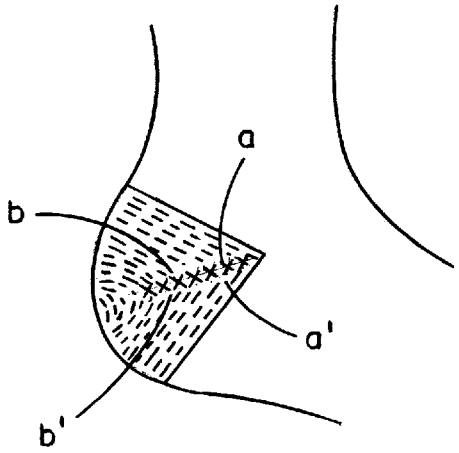
FIG. 1 is a side elevational and fragmentary view of a hosiery blank showing a conventional gore design in the formed heel pocket area, the band of tuck stitches bordering each side of the pocket area along the gore line and the sequential change in the number of knit stitches in each partial course in the pocket area all made in accordance with the present invention.
Figure 4:
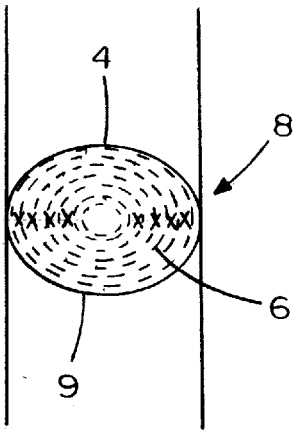
FIG. 4 is a rear elevational and fragmentary view of the blank of FIG. 1 formed in accordance with the present invention showing the pocket with the gore lines shown as x's and the partial courses shown in dotted lines.
Figure 5:
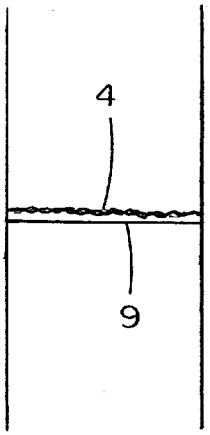
FIG. 5 is a front elevational view of the blank shown in FIG. 4.

As a general example, the invention is a process for knitting a tubular blank to be formed into a leg covering garment on a multi-feed circular knitting machine totally by rotary knitting and can include rotary knitting continuous complete courses of knit stitches on all needles before or after the formation of a knit pocket. In order to initiate formation of the pocket at a selected time, knitting on some of the needles (for example, needles on the instep side of the heel area) is terminated and, partial courses are formed with less than all needles, each of the partial courses preferably including first a selected number of yarn end securing stitches such as tuck stitches, then a selected number of knit stitches, and then a selected number of securing stitches referred to hereinafter for convenience as tuck stitches. Rotary knitting partial courses with tuck stitches and a varying number of knit stitches in each course continues for a selected number of courses. The number of knit stitches are increased or decreased for a selected number of courses and then are decreased or increased (inversed) for a selected number of courses until the desired number of courses having sequentially different numbers of knit stitches is completed to form a knitted pocket like that shown in FIGS. 1 through 5. In FIG. 4, the top outer arcuate solid line 4 represents the rearward part of the last full course of knit stitches before the knitting of partial courses begins when the knit pocket 6 on the blank 8 is viewed from the rear. The lower outer arcuate solid line 9 represents the rearward part of the first full course of knit stitches after the knitting of partial courses is terminated when knit pocket 6 of blank 8 is viewed from the rear. In FIG. 5, the forward portions of full courses 4 and 9 are shown on the front side of blank 8 where no partial course knitting takes place.

Figure 2:
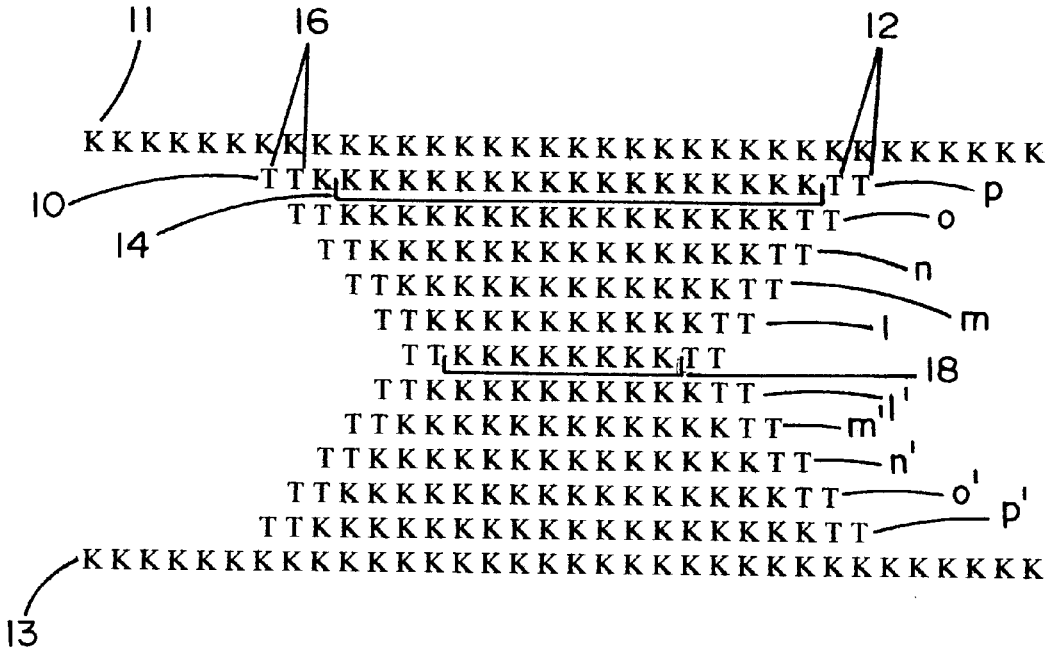
FIG. 2 is a schematic view of the stitch configuration forming the gore design in the pocket shown in FIG. 1.

A more precise example is shown in FIG. 2 where, after knitted full courses, the last of which is designated 11, a selected number of tuck stitches 12 are initially knitted at the start of the first partial course 10 which is then followed by knitting a selected number of knit stitches 14 and ended with a selected number of tuck stitches 16. As partial course rotary knitting continues, the number of knit stitches is reduced until a minimum number 18 is reached at which time the process is reversed (inversed), and the number of rotary knit stitches for each partial course is increased sequentially to match the decreasing number until the number of partial courses having sequentially different numbers of knit stitches is equal to the number of partial courses having sequentially different inverse numbers of knit stitches to form a knitted pocket. Full course knitting commences thereafter with the initial full course designated 13 being the first following partial course knitting.

FIG. 2 identifies locations l, l'; m, m'; n, n'; o, o'; p, p' and q, q' along one edge of the gore design area, it being understood that there are identical designated locations along the other edge of that area. These are again illustrations of shared locations on the actual joined gore line, i.e.; l, l' are at the same location; m, m' are at the same location; n, n' are at the same location and so on for the length of the gore.

Yarns introduced at the beginning of the partial courses and remaining at the end of the partial courses are trimmed by conventional apparatus of the knitting machine well known in the art. The trimmed yarns are formed because the group of needles which are knitting the partial courses are in a yarn receiving position, whereas the needles not knitting are in a down position so as not to receive yarn.

The number of knit stitches 14 can be varied from partial course to partial course without limitation. For example, the number of knit stitches in the longest partial course 10 can be reduced, for example, by a number of stitches other than shown in FIG. 2, or the number of stitches can be maintained constant for several courses until reduction of one or more stitches takes place. The shaping of the pocket area is flexible since the gore area configuration can be varied as desired. It is not necessary that the gore design be symmetrical since the upper portion of the pocket area shown generally as 20 from the longest knit stitch course to the shortest knit stitch course can be knitted in its complete form and inverse knitting be continued for only a short duration. There is no limitation with respect to the shape or design of the pocket area because of the knitting machine's capability for varying partial course length.

Similarly, the band of tuck stitches 12 can be varied by the number of individual tuck stitches in each partial course on either side of the pocket area. Band 12 can also have a combination of different stitches so long as they serve as yarn end securing stitches. Moreover, a variety of patterns utilizing different stitch types within the group of partial course needles is possible with the present invention since continued rotary cylinder movement does not interfere with the patterning capabilities of the knitting machine as would be the case in reciprocatory knitting. Color can be added to patterns by introducing different colored yarns at different feeds.

As referenced earlier, the use of the terms "tuck stitch" and "tuck stitches" is for convenience, it being understood that they represent one of any number of stitch configurations or combinations that may be utilized as yarn end securing stitches.

Figure 9:
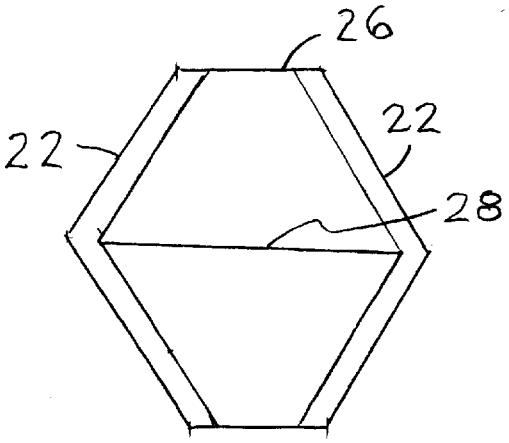
FIG. 9 is a schematic view of the stitch configuration forming the gore design shown in FIG. 8.
Figure 6:
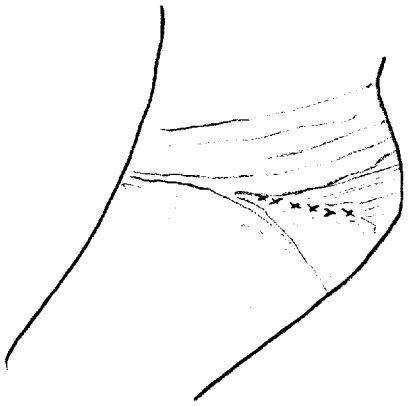
FIG. 6 is a schematic view of a conventional straight gore design formed by reciprocatory knitting constituting prior art and is similar in appearance to the hosiery blank with the straight gore design shown in FIG. 1 and made in accordance with the present invention.
Figure 7:
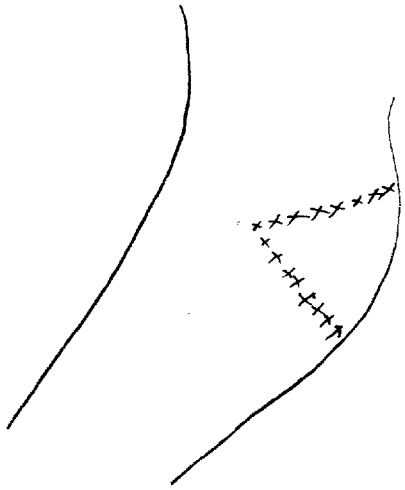
FIG. 7 is an alternative embodiment of the present invention illustrating a diamond shaped design of the pocket area showing the tuck stitch borders and the varying lengths of partial knit courses.
Figure 12:
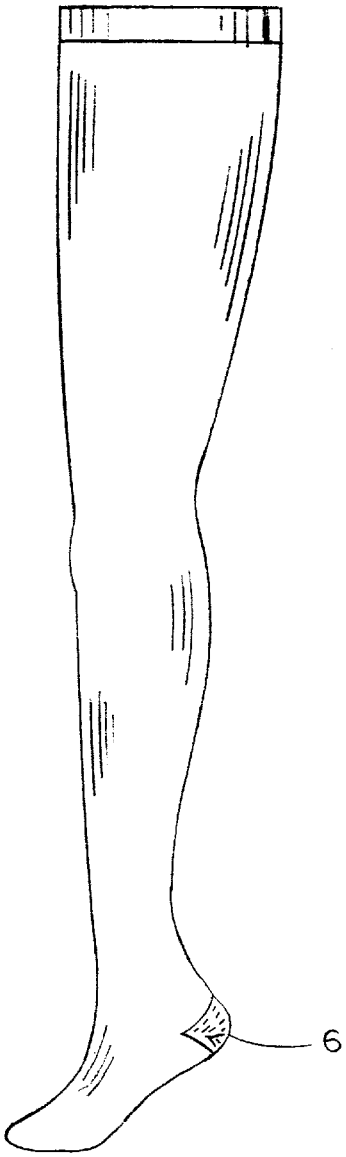
FIG. 12 is a front elevational view of a hosiery product made in accordance with the present invention as shown in FIGS. 1 through 5.
Figure 13:
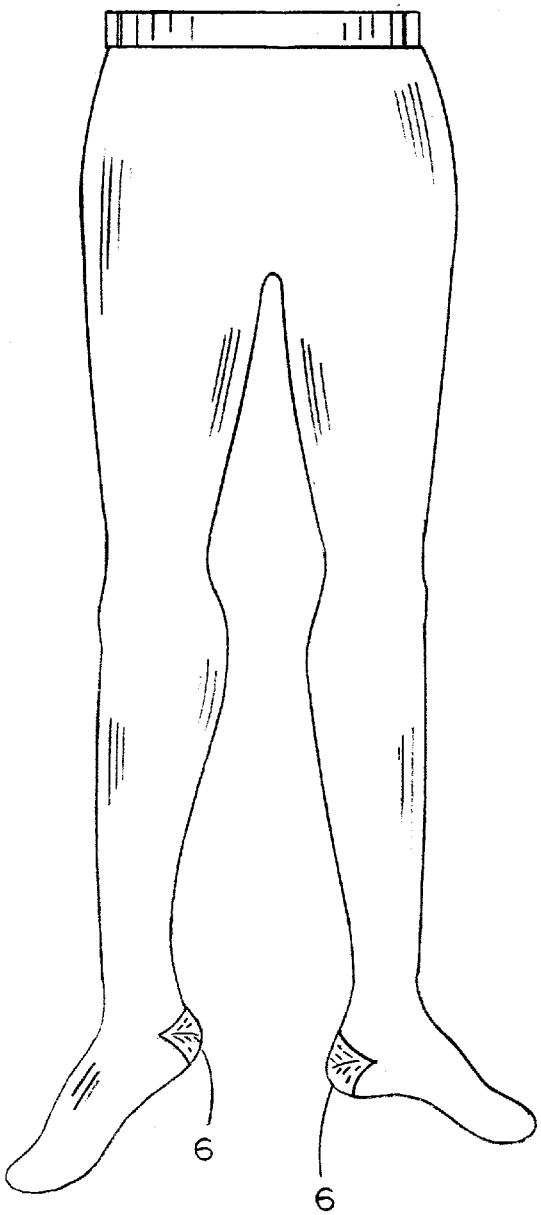
FIG. 13 is a pantyhose garment made in accordance with the present invention as shown in FIGS. 1 through 5.

An example of an alternative embodiment utilizing the present inventive process for knitting a different area design is shown in FIGS. 7 and 9. Each partial course is preceded by a selected number of tuck stitches to form a band 22, and then a selected number of knit stitches are made starting at location 26 and increasing in number for each partial course until a maximum number is reached at location 28. Knit stitches are then reduced in each course to match, in the example illustrated, those previously formed until a symmetrical design is accomplished.

The schematic stitch configuration is shown in FIG. 8 for this example where after the last full course of knitted stitches 29, partial course 30 is formed by providing two tuck stitches 32 knit stitches 34, and two more tuck stitches 33 thereafter. The number of knit stitches per partial course increases until a maximum shown as 36 is reached. Partial knit course construction is decreased sequentially until it matches the number of knit stitches included in each corresponding and inversely reflected course. Again, locations r, r'; s, s'; t, t'; u, u'; v, v' and w, w' are provided along both edges of the gore design area to illustrate the shared locations on the actual joined gore line, i.e., r, r' are at the same location; s, s' are at the same location; t, t' are at the same location and so on.

From this detailed description, it can be seen that a process for expeditiously forming leg covering garments with knitted blanks for heel and toe closures has been provided that will overcome the disadvantages of prior art devices and offer additional advantages not offered by the prior art. The foregoing is considered as illustrative only of the principles of the invention. Since numerous modifications and changes will readily occur to those skilled in the art, it is not intended to limit the invention to the exact construction and operation shown and described. All suitable modifications and equivalents that fall within the scope of the appended claims are deemed within the present inventive concept.

What is claimed is:

1. The process of rotary knitting a tubular blank with a pocket for a tubular product on a multi-feed circular knitting machine comprising the steps of: rotary knitting continuous courses of stitches on all needles; forming a pocket on the blank by rotary knitting partial courses, each partial course formed by knitting a selected number of stitches to form a pocket on one side of the blank while no other knitting on the blank is taking place; and selecting the length of the partial courses in order to create a gore design area and form a knitted pocket.

2. The blank as claimed in claim 1 wherein the pocket portion partial are knitted to include one or more yarn and securing stitches at the beginning and end of each partial course contiguous with a partial course stitches.

3. The blank as claimed in claim 1 further comprising: knitting a lower portion having a plurality of rotary knit full course of stitches encompassing the blank first and second sides.

4. The process of rotary knitting a tubular blank with a pocket for a tubular product on a multi-feed circular knitting machine comprising the steps of: rotary knitting continuous courses of stitches on all needles; forming a pocket on the blank by rotary knitting partial courses, each partial course formed by knitting a selected number of yarn end securing stitches, then a selected number of stitches, and then a selected number of yarn end securing stitches to form a pocket on one side of the blank while no other knitting on the blank is taking place; and selecting the length of the partial courses in order to create a gore design area and form a knitted pocket.

5. The blank claimed in claim 4 further comprising: knitting a lower portion having a plurality of rotary knit courses of stitches encompassing the blank first and second sides.

6. The process of rotary knitting a tubular blank with a pocket for a tubular product on a multi-feed circular knitting machine comprising the steps of: rotary knitting continuous courses of stitches on all needles; commencing the formation of a pocket on the blank by continuing in rotary knitting to knit partial courses, each partial course formed by knitting a selected number of yarn end securing stitches, then a selected number of knit stitches, and then a selected number of yarn end securing stitches to form a pocket on one side of the blank while no other knitting of the blank is taking place; and continuing to rotary knit partial courses with yarn end securing stitches and stitches in each course for a selected number of courses to create a gore design area and form a knitted pocket.

7. The process of rotary knitting a tubular blank with a pocket for a tubular product on a multi-feed circular knitting machine comprising the steps of: rotary knitting continuous courses of stitches on all needles; forming a pocket on the blank by rotary knitting partial courses, each partial course formed by knitting a selected number of yarn end securing stitches, then a selected number of knit stitches, and then a selected number of yarn end securing stitches to form a pocket on one side of the blank while no other knitting on the blank is taking place; selecting the length of the partial courses in order to create a gore design area and form a knitted pocket; and returning to full course knitting and continuing to knit full courses of stitches.

8. The process of rotary a tubular blank with a pocket for a tubular product on a multi-feed circular knitting machine comprising the steps of: rotary knitting continuous courses of stitches on all needles; forming a pocket on the blank by rotary knitting partial courses, each partial course formed by knitting a selected number of yarn end securing stitches, then a selected number of stitches, and then a selected number of yarn end securing stitches to form a pocket on one side of the blank while no other knitting on the blank is taking place; continuing to rotary knit partial courses with yarn end securing stitches and knit stitches in each course for a selected number of courses to create a gore design area and form a knitted product; and returning to full course knitting and continuing to knit full courses of knit stitches.

* * * * *

UNITED STATES PATENT AND TRADEMARK OFFICE

CERTIFICATE OF CORRECTION

PATENT NO. : 6,178,781 B1
DATED : January 30, 2001
INVENTOR(S) : Jonathan M. Myers It is certified that error appears in the above-identified patent and that said Letters Patent is hereby corrected as shown below:

Column 6, claim 2,
Line 2, insert -- courses -- between "partial" and "are" and replace "and" with -- end --; and in column 6, line 4, replace "a" with -- the --, so that claim 2 reads as follows:

2. The blank as claimed is claim 1 wherein the pocket portion partical courses are knitted to include one or more yarn end securing stitches an the beginning and end of each partial course contiguous with the ;artial couse stitches.

Column 6, claim 8,
Line 49, insert -- knitting -- after "rotary", so that claim 8 reads as follows"

8. The process of rotary knitting a tubular blank with a pocket for a tubular product on multi-feed circular knitting machine comprising the steps of: rotary knitting continuous courses of stitches on all needles; forming a pocket on the blank by rotary knitting partial courses, each partial course formed by knitting a selected number of yarn end securing stitches, then a selected number of stitches, and then a selected number of yarn end securing stitches to form a pocket on one side of the blank while no other knitting on the blank is taking place; continuing to rotary knit partial courses with yarn end securing stitches and knit stitches in each course for a selected number of courses to create a gore design area and form a knitted product; and returning to full course knitting and continuing to knit full courses of knit stitches.

Signed and Sealed this

Twenty-sixth Day of March, 2002

*Attest:*

*Attesting Officer*

JAMES E. ROGAN
*Director of the United States Patent and Trademark Office*